US006786354B2

(12) United States Patent
Black et al.

(10) Patent No.: US 6,786,354 B2
(45) Date of Patent: Sep. 7, 2004

(54) MEDIA CASSETTE

(75) Inventors: Jonathan S. Black, Dundee (GB); Scott P. Mackenzie, Dundee (GB)

(73) Assignee: NCR Corporation, Dayton, OH (US)

( * ) Notice: Subject to any disclaimer, the term of this patent is extended or adjusted under 35 U.S.C. 154(b) by 96 days.

(21) Appl. No.: 10/236,730

(22) Filed: Sep. 6, 2002

(65) Prior Publication Data

US 2003/0071048 A1 Apr. 17, 2003

(30) Foreign Application Priority Data

Oct. 17, 2001 (GB) ..... 0124867

(51) Int. Cl.[7] ..... G07F 11/00
(52) U.S. Cl. ..... 221/6; 221/56
(58) Field of Search ..... 221/2, 6, 7, 9, 221/13, 197, 198; 271/145, 162; 255/379, 383, 380; 902/8, 9, 13, 27

(56) References Cited

U.S. PATENT DOCUMENTS 4,566,547 A 1/1986 Furukawa
4,748,479 A 5/1988 Ohira et al.
4,816,652 A * 3/1989 Wildgoose et al. ..... 235/379
5,141,127 A * 8/1992 Graef et al. ..... 221/4
5,561,281 A 10/1996 Eda et al.
6,100,993 A * 8/2000 Eom ..... 358/1.14

FOREIGN PATENT DOCUMENTS

DE 199 4 540 A 8/2000
DE 19904540 A1 * 8/2000

OTHER PUBLICATIONS

Online (WPI) abstract for JP7237780 A, Sep. 12, 1995, Fuji Xerox Co Ltd, Paper Sheet Detecting Device for Paper Feeding Device.
Online (PAJ) abstract for JP5097278 A, Apr. 20, 1993, Fuji Xerox Co Ltd, Remaining Sheet Amount Detector.
Online (PAJ) abstract for JP1267233 A, Oct. 25, 1989, Toshiba Corp, Image Forming Device.
Online (WPI) abstract for JP60262733 A, Dec. 26, 1985, Fuji Xerox KK, Sheets Feed Cassette for Photoelectronic Copying.

* cited by examiner

*Primary Examiner*—Kenneth Noland
(74) *Attorney, Agent, or Firm*—Michael Chan

(57) ABSTRACT

A cassette (10) for storing media in sheet form is described. The cassette (10) has urging means (26) for urging a stack of media items (34) to one end (24) of the cassette (10), such as a media pick area (22). The cassette (10) also has sensing means (52) for determining the size of the stack of media items (34) remaining in the cassette (10). The cassette (10) includes display means (50) for displaying to an external viewer, such as a replenisher, an indication of the size of the stack of media items (34) remaining within the cassette (10).

19 Claims, 1 Drawing Sheet

MEDIA CASSETTE

BACKGROUND OF THE INVENTION

The present invention relates to a media cassette for storing valuable media in sheet form. In particular, the invention relates to a media cassette for use in a self-service terminal (SST), such as a currency cassette for use in an Automated Teller Machine (ATM).

Currency cassettes provide ATMs with a source of banknotes, and are strong metal or plastics boxes comprising a lid releasably coupled to a body. One end of the body includes a covered aperture that is automatically opened when the cassette is inserted into a currency dispenser, and automatically closed when the cassette is removed from the currency dispenser. The opposite end of the body includes a handle for carrying the cassette, and to aid insertion and removal of the cassette. When a cassette is inserted into a currency dispenser, only the handle end of the cassette is visible.

Periodically, currency cassettes require replenishment to ensure that the ATM in which the cassettes are located has sufficient banknotes to fulfil cash withdrawal transactions.

A replenishment operation typically involves a secure carrier (such as a cash-in-transit company) visiting the ATM, removing a partially filled currency cassette, and replacing it with a full currency cassette. The secure carrier then transports the partially filled currency cassette to a bullion center to reconcile the number of banknotes remaining in the cassette and the number of banknotes dispensed from the ATM with the total number of banknotes originally loaded into the cassette.

As some ATMs are used more frequently than other ATMs, not every ATM requires replenishment at the same time. However, it is difficult for a replenisher to determine how full an ATM cassette is without opening the cassette, which involves a significant risk of theft because:

(1) the time taken to perform a replenishment operation is increased, and (2) the notes within a cassette are exposed while the cassette is open.

To minimize the risk of theft, a replenisher typically replaces every currency cassette in an ATM regardless of how full or empty each cassette is.

SUMMARY OF THE INVENTION

It is among the objects of an embodiment of the present invention to obviate or mitigate the above disadvantage or other disadvantages associated with media cassettes.

According to a first aspect of the present invention there is provided a media cassette comprising: urging means for urging a stack of media items to one end of the cassette, sensing means for determining the size of the stack of media items; and display means for displaying to an external viewer an indication of the size of the stack.

Preferably, the sensing means determines the size of the stack from the position of the urging means.

Preferably, the sensing means includes a variable resistor circuit, where movement of the urging means changes the resistance of the circuit.

Preferably, the variable resistor circuit includes a resistive rod having a uniform resistivity value and in electrical contact with the urging means, so that the position of the urging means along the resistive rod determines the resistance sensed.

Preferably, the urging means comprises a pusher plate slidably mounted on a ratchet for urging media items towards a media pick end opposite a handle end.

Preferably, the display means is located on the handle end.

Preferably, the display means includes a plurality of elements, each element corresponding to a region occupied by media items when the cassette is full, where adjacent elements correspond to adjacent regions, such that when a region is occupied the corresponding element is in one state, and when the region is unoccupied the corresponding element is in a different state.

In one embodiment, the display means comprises a plurality of light emitting diodes (LEDs), whereby when the cassette is full of banknotes all diodes are illuminated, when the cassette is at a critically low level (fewer than a predetermined number of banknotes) no diodes are illuminated, and between these two limits there is a linear relationship between the number of LEDs illuminated and the how many media items remain in the cassette. Alternatively, the LEDs may be bi-state, such that if all of the LEDs are a first color (for example, green) then the cassette is full; whereas if all of the LEDs are a second color (for example, red) then the number of notes in the cassette has fallen below a critical level.

Alternatively, the display means may be implemented by a display such as an LCD or a seven segment display.

By virtue of this aspect of the present invention, a replenisher is able to determine how full a cassette is without removing the cassette from a dispenser.

According to a second aspect of the present invention there is provided a method of indicating the quantity of media items in a cassette, the method comprising the steps of: sensing the position of an urging mechanism for urging media items to a pick area, and displaying a representation of the quantity of media items remaining in the cassette based on the sensed position.

The word "media" is used herein in a generic sense to denote one or more items, documents, or such like having a generally laminar sheet form; in particular, the word "media" when used herein does not necessarily relate exclusively to multiple items or documents. Thus, the word "media" may be used to refer to a single item (rather than using the word "medium") and/or to multiple items.

BRIEF DESCRIPTION OF THE DRAWINGS

These and other aspects of the present invention will be apparent from the following specific description, given by way of example, with reference to the accompanying drawings, in which.

DETAILED DESCRIPTION

Figure 1:
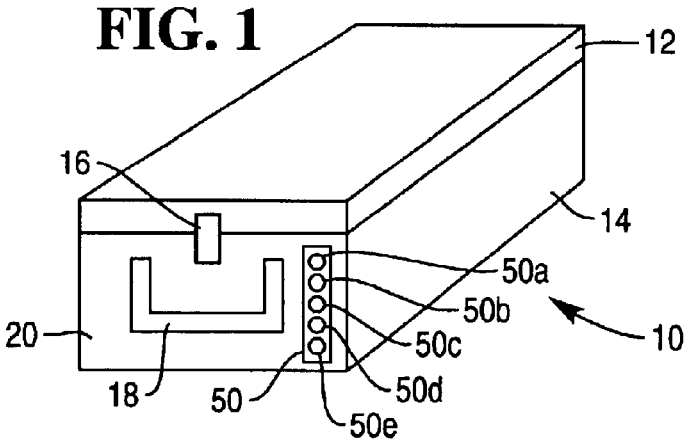
FIG. 1 is a schematic perspective view of a media cassette according to one embodiment of the present invention.
Figure 2:
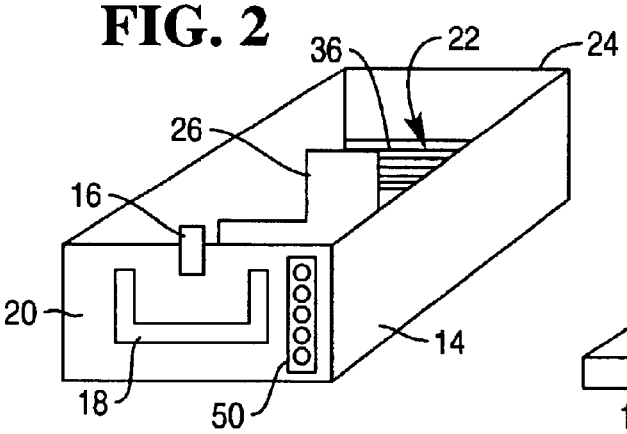
FIG. 2 is a schematic perspective view of a body portion of the cassette of FIG. 1.
Figure 3:
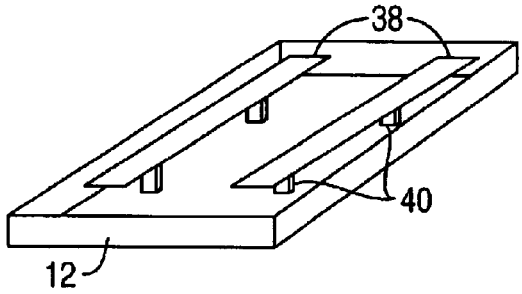
FIG. 3 is a schematic perspective underside view of a lid portion of the cassette of FIG. 1.
Figure 4:
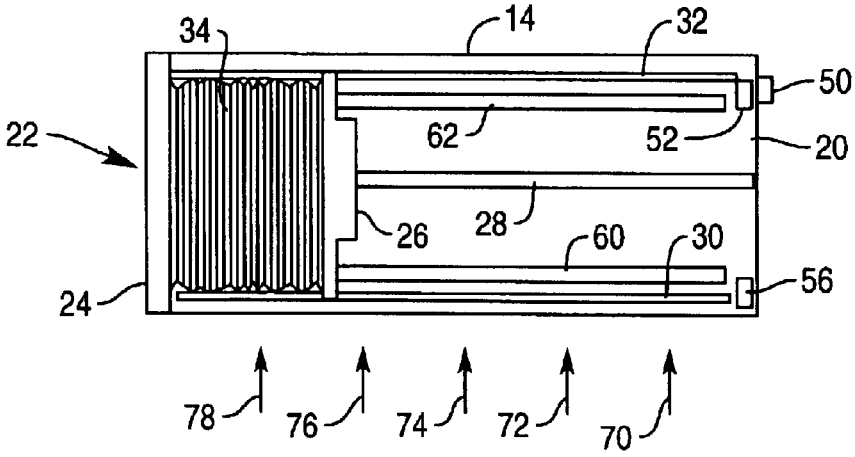
FIG. 4 is a schematic plan view of the body portion of the cassette of FIG. 2.

Referring to FIGS. 1 to 4, a media cassette 10, in the form of a polycarbonate currency cassette for storing banknotes, has a lid 12 secured to a body 14 by a latch 16. The body 14 has a handle 18 pivotably mounted at a handle end 20, and a pick area 22 at a pick end 24 opposite the handle end 20.

A pusher plate 26 is mounted on a linear ratchet 28 extending from the handle end 20 to the pick end 24, and is urged towards the pick end 24 by a resilient member (not shown). The pusher plate 26 is made of metal and is mounted above two lateral guides 30,32 for guiding opposite short edges of banknotes 34 as the banknotes are urged towards the pick end 24.

The body 14 has a roller shutter 36 covering the pick area 22, so that when the cassette 10 is inserted into an ATM (not shown), tines in the ATM engage with recesses (not shown) in the body 14, and the roller shutter 36 is automatically lowered by the tines to allow banknotes 34 to be picked from the pick area 22 by a cash dispenser pick unit (not shown) in the ATM (not shown). When the cassette 10 is removed from the ATM (not shown), the tines in the ATM disengage from the recesses (not shown) in the body 14, and the roller shutter 36 is urged upwards to cover the pick area 22 and prevent access to the banknotes 34 in the cassette 10.

The underside of the lid 12 includes two banknote long-edge aligners 38 mounted on adjustable spacers 40. The aligners 38 prevent banknotes 34 stored within the cassette 10 from moving towards the lid 12 during transportation.

The handle end 20 includes display means 50 in the form of five LEDs (50*a* to 50*e*) individually controlled by a simple logic circuit 52. When the cassette 10 is filled with notes, all of the LEDs 50 are illuminated by the LED circuit 52.

The body 14 includes sensing means comprising a potentiometer circuit coupled to the LED circuit 52. The potentiometer circuit comprises a power supply 56 (in the form of a battery), two electrically conducting rails 60,62, and the pusher plate 26. The two rails 60,62 extend from near the handle end 20 to near the pick end 24, and opposite sides of the pusher plate 26 are in electrical contact with the rails 60,62. One rail 60 is made of metal and has a low resistance, the other rail 62 is a resistive rod having a uniform cross section and a high resistivity. In this embodiment, the resistive rod 62 is approximately 300 mm long.

The LED circuit 52 is calibrated to change state at each of five points, spaced approximately 50 mm apart. When the pusher plate 26 is near the handle end 20 (point 70 in FIG. 4), the resistance of the rod portion between the pusher plate 26 and the LED circuit 52 is approximately one thousand ohms (1 kΩ). When the pusher plate 26 is at point 72, the resistance of the rod portion between the pusher plate 26 and the LED circuit 52 is approximately two thousand ohms (2 kΩ). Similarly, at point 74, the rod portion has a resistance of three thousand ohms (3 kΩ), at point 76 four thousand ohms (4 kΩ), and at point 78 five thousand ohms (5 kΩ).

As notes 34 are picked from the cassette 10, the pusher plate 26 moves from the handle end 20 towards the pick end 24 and the resistance of the potentiometer circuit increases by a small amount each time the pusher plate 26 moves. This increased resistance is detected by the LED circuit 52.

Initially, when the cassette 10 is full of banknotes 34, the pusher plate is at the handle end 20, the resistance of the rod portion (the portion of rod 62 between the pusher plate 26 and the LED circuit 52) is less than one thousand ohms, and the LED circuit 52 illuminates all five LEDs 50*a* to 50*e*.

As notes 34 are removed from the cassette 10, the pusher plate 26 moves towards the pick end 24 and the resistance of the rod portion increases beyond one thousand ohms. When this occurs (point 70), the LED circuit 52 extinguishes the LED 50*a* nearest the lid 12. When the resistance increases beyond two thousand ohms, the LED circuit 50*b* extinguishes the next LED 50*b*. When the resistance increases beyond three thousand ohms, the LED circuit 52 extinguishes the third LED 50*c*, and so on until the resistance increases beyond five thousand ohms, indicating that the number of notes remaining in the cassette 10 has fallen below a critical level, and the final LED 50*e* is extinguished.

When a replenisher opens the ATM (not shown) to access the currency cassette 10, the replenisher can immediately determine how full the cassette 10 is by counting the number of LEDs illuminated. In this embodiment, the replenisher has been instructed to replace the cassette if three or fewer LEDs are illuminated.

Various modifications may be made to the above described embodiment within the scope of the invention, for example, instead of LEDs a single display, such as an LCD, may be used.

What is claimed is:

1. A currency cassette comprising:

urging means for urging a stack of currency items to one end of the currency cassette;

electrical sensing means for determining size of the stack of currency items; and electrical displaying means for displaying to an external viewer an indication of the size of the stack of currency items.

2. A currency cassette according to claim 1, wherein the electrical sensing means determines the size of the stack of currency items from the position of the urging means.

3. A currency cassette according to claim 1, wherein the electrical sensing means includes a variable resistor circuit, where movement of the urging means changes the resistance of the circuit.

4. A currency cassette according to claim 1, wherein the urging means comprises a pusher plate slidably mounted on a ratchet for urging currency items towards a media pick end opposite a handle end.

5. A currency cassette according to claim 4, wherein the electrical displaying means is located on the handle end.

6. A currency cassette according to claim 1, wherein the electrical displaying means includes a plurality of elements, each element corresponding to a region occupied by currency items when the currency cassette is full, where adjacent elements correspond to adjacent regions, such that when a region is occupied the corresponding element is in one state, and when the region is unoccupied the corresponding element is in a different state.

7. A currency cassette comprising:

means defining a currency storage space in which a stack of media items can be placed;

means for urging a stack of media items contained in the currency storage space to one end of the currency storage space;

electrical means for determining size of a stack of currency items contained in the currency storage space; and electrical means for indicating the size of a stack of currency items contained in the currency storage space.

8. A currency cassette according to claim 7, wherein the electrical means for determining size of a stack of currency items contained in the currency storage space includes a variable resistor circuit having a resistance which varies as a function of the position of the means for urging a stack of currency items contained in the currency storage space.

9. A currency cassette according to claim 7, wherein the means for urging a stack of currency items contained in the currency storage space comprises a pusher plate slidably mounted on a ratchet for urging currency items towards the one end of the currency storage space.

10. A currency cassette having a currency storage space, the currency cassette comprising:

a first electrical circuit for determining size of a stack of currency items contained in the currency storage space and for providing an electrical signal indicative thereof; and a second electrical circuit for indicating the size of a stack of currency items contained in the currency storage space based upon the electrical signal from the first electrical circuit.

11. A currency cassette according to claim 10, further comprising a mechanical mechanism for urging currency items contained in the media currency storage space to one end of the currency storage space.

12. A currency cassette according to claim 11, wherein the mechanical mechanism includes a pusher plate slidably mounted on a ratchet for urging currency items contained in the currency storage space to the one end of the currency storage space.

13. A currency cassette according to claim 12, wherein the first electrical circuit includes a variable resistor circuit having a resistance which varies as a function of the position of the pusher plate.

14. A currency cassette according to claim 13, wherein the variable resistor circuit includes a resistive rod which is coupled to the pusher plate to provide the varying resistance as a function of the position of the pusher plate.

15. A currency cassette according to claim 10, wherein the second electrical circuit includes a plurality of elements, each element corresponding to a region occupied by currency items when the currency storage space is full, where adjacent elements correspond to adjacent regions, such that when a region is occupied the corresponding element is in one state, and when the region is unoccupied the corresponding element is in a different state.

16. A method of indicating the quantity of currency items in a currency cassette, the method comprising the steps of:

electrically sensing the position of an urging mechanism for urging currency items to a pick area; and electrically displaying a representation of the quantity of currency items remaining in the currency cassette based on the sensed position.

17. A method of operating a currency cassette, the method comprising the steps of:

determining size of a stack of currency items contained in the currency cassette and providing an electrical signal indicative thereof; and electrically displaying a representation of the size of the stack of currency items contained in the currency cassette based upon the electrical signal.

18. A media cassette comprising:

urging means for urging a stack of media items to one end of the cassette;

sensing means for determining size of the stack of media items, the sensing means including a variable resistor circuit, where movement of the urging means changes the resistance of the circuit, the variable resistor circuit including a resistive rod having a uniform resistivity and being in electrical contact with the urging means, so that the position of the urging means along the resistive rod determines the resistance sensed; and displaying means for displaying to an external viewer an indication of the size of the stack of media items.

19. A media cassette comprising:

means defining a media storage space in which a stack of media items can be placed;

means for urging a stack of media items contained in the media storage space to one end of the media storage space;

means for determining size of a stack of media items contained in the media storage space, the means for determining size of a stack of media items contained in the media storage space including a variable resistor circuit having a resistance which varies as a function of the position of the means for urging a stack of media items contained in the media storage space, the variable resistor circuit including a resistive rod which electrically contacts the means for urging a stack of media items contained in the media storage space and which provides the varying resistance as a function of the position of the means for urging a stack of media items contained in the media storage space; and means for indicating the size of a stack of media items contained in the media storage space.

* * * * *